US012637270B2

(12) United States Patent
Bickel et al.

(10) Patent No.: US 12,637,270 B2
(45) Date of Patent: May 26, 2026

(54) CONTAINER CLOSURE

(71) Applicant: ALPLA WERKE ALWIN LEHNER GMBH & CO. KG, Hard (AT)

(72) Inventors: Jürgen Bickel, Dornbirn (AT); Franz-Michael Lässer, Lochau (AT)

(73) Assignee: ALPLA WERKE ALWIN GMBH & CO., Hard (AT)

( * ) Notice: Subject to any disclaimer, the term of this patent is extended or adjusted under 35 U.S.C. 154(b) by 0 days.

(21) Appl. No.: 18/564,587

(22) PCT Filed: May 24, 2022

(86) PCT No.: PCT/EP2022/064070
§ 371 (c)(1),
(2) Date: Nov. 27, 2023

(87) PCT Pub. No.: WO2022/248483
PCT Pub. Date: Dec. 1, 2022

(65) Prior Publication Data

US 2024/0375837 A1 Nov. 14, 2024

(30) Foreign Application Priority Data

May 26, 2021 (CH) ..... 00592/21

(51) Int. Cl.
*B65D 51/24* (2006.01)
*B65D 41/32* (2006.01)
(Continued)

(52) U.S. Cl.
CPC ..... *B65D 51/24* (2013.01); *B65D 41/325* (2013.01); *B65D 41/3428* (2013.01);
(Continued)

(58) Field of Classification Search
CPC ..... B65D 47/06; B65D 47/36; B65D 51/24; B65D 55/16; B65D 55/024; B65D 1/0238;
(Continued)

(56) References Cited

U.S. PATENT DOCUMENTS 3,330,720 A * 7/1967 Stevens ..... B65D 41/045 428/327

FOREIGN PATENT DOCUMENTS

CA 2672864 A1 * 7/2008 ..... B65D 41/045
CA 2428077 C * 7/2010 ..... B65D 41/3452
(Continued)

*Primary Examiner* — Robert J Hicks
(74) *Attorney, Agent, or Firm* — Morriss O'Bryant Compagni Cannon, PLLC

(57) ABSTRACT

The invention relates to a container closure for closing a pouring opening of a container which is filled with a liquid, having: a closure cap, which has a free edge, a shell and a top plate; a tamper-evident ring, which is designed to be retained form-fittingly on a container neck of the container; and a retaining element having a first and a second end, the first end being firmly connected to the free edge of the closure cap and the second end being firmly connected to the tamper-evident ring. The closure cap is transferable from a closure position, in which it closes the pouring opening, into an open position, in which it fully opens up the pouring opening, and vice versa. An adhesion surface for improving the adhesion of liquid is provided on the inner side of the top plate coming into contact with liquid.

22 Claims, 4 Drawing Sheets

Figure 1:
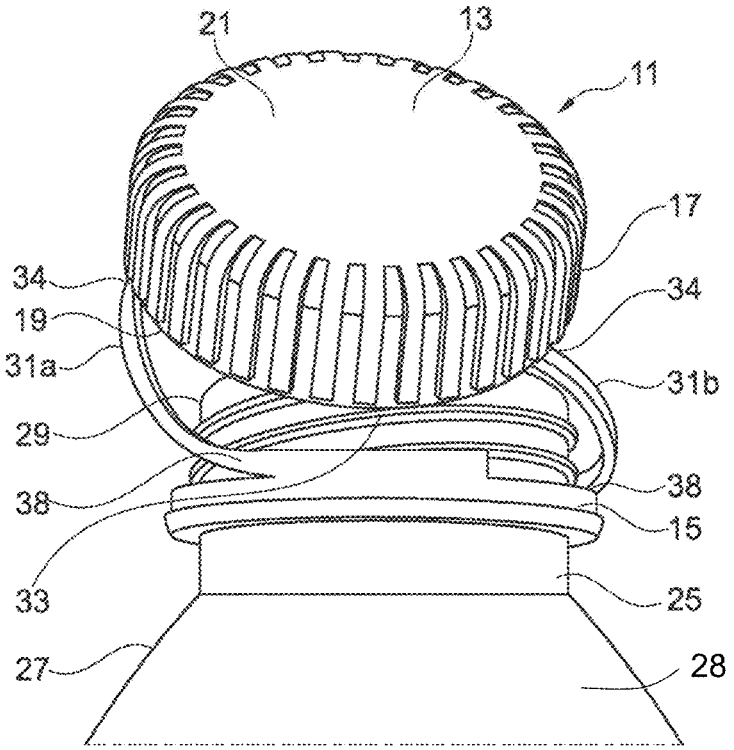

(51) Int. Cl.
*B65D 41/34* (2006.01)
*B65D 41/46* (2006.01)
*B65D 47/06* (2006.01)
*B65D 55/16* (2006.01)

(52) U.S. Cl.
CPC ..... *B65D 41/465* (2013.01); *B65D 47/06* (2013.01); *B65D 55/16* (2013.01); *B65D 2401/30* (2020.05)

(58) Field of Classification Search
CPC B65D 41/045; B65D 41/0435; B65D 41/325; B65D 41/32; B65D 41/3428; B65D 41/3423; B65D 41/465
USPC ..... 215/254, 253, 252, 250, 347, 341, 316, 215/44, 306; 220/266, 265, 375
See application file for complete search history.

(56) References Cited

FOREIGN PATENT DOCUMENTS

| | | | | |
|---|---|---|---|---|
| CH | 715914 | A1 | 9/2020 | |
| EP | 0204425 | A2 | 12/1986 | |
| WO | 2011062995 | A2 | 5/2011 | |
| WO | WO-2019207119 | A2 * | 10/2019 | ..... B65D 55/16 |

* cited by examiner

CONTAINER CLOSURE

CROSS-REFERENCE TO RELATED APPLICATIONS

This application is a national phase entry under 37 U.S.C § 371 of PCT/EP2022/064070 filed May 24, 2022, which claims priority to Swiss Patent Application No. 00592/21 filed May 26, 2021, the entirety of each of which is incorporated by this reference.

FIELD OF THE INVENTION

The invention relates to a container closure and to a container having a container closure.

PRIOR ART

Closure caps which are captively retained on the container and close the pouring opening thereof are known from the prior art in the field of plastic container closures having a tamper-evident band. Also known are plastic container closures in which the closure cap is connected to the tamper-evident band in an articulated manner and can thus be folded away from the pouring opening and can be folded back onto the pouring opening after use (so-called flip-top closures).

In particular in the case of beverages which have to be shaken before use (e.g., milk-based beverages or fruit juices), a residual amount of the beverage remains adhered to the inner side of the lid. When drinking from the container or bottle, these residual amounts are bothersome because the opened closure cap is connected to the bottle and the soiled cap is close to one's face. The end user must fear that the residual amount will flow out and soil the end user.

Advantages of the Invention

The disadvantages of the described prior art result in a captive closure cap in which the inner side is designed such that the residual amount of liquid adhering to the inner side of the closure cap remains securely in the closure cap.

SUMMARY OF THE INVENTION

An advantageous container closure is achieved by the features stated in the independent claims. Developments and/or advantageous alternative embodiments form the subject-matter of the dependent claims.

The invention provides an adhesion surface for improving the adhesion of liquid is provided on the inner side of the top plate coming into contact with liquid. This adhesion surface makes it possible in a simple manner that liquid adhering to the inner side of the closure cap after opening does not drip onto the face or the clothing of the user, but rather adheres reliably to the top plate.

In one embodiment of the invention, the adhesion surface is realized by a structure having alternating elevations and cells, wherein the cells formed between the elevations serve to build up an adhesive force with respect to the liquid. A capillary effect or capillary rise acts in the cells, whereby liquid is held in each cell and cannot drip off. The cells are closed on one side and have a filling opening opposite from the top plate. In the case of a typical inner diameter of the top plate of approximately 30 mm, at least 2 ml of liquid are retained on the structure and reliably do not drip off. In the case of a viscosity of the liquid which is higher than that of water, even more liquid can be held on the adhesion structure.

It has proven expedient if the elevations are walls enclosing the cells, said walls delimiting adjacent cells. By virtue of the thin walls, as many cells as possible can be produced on the inner side of the top plate and as little plastic as possible is required for producing the structure.

It is expedient for the cells to be polygonal cavities, since they have a favorable ratio of wall material to cell volume. Liquid adheres particularly well in the corners.

In another embodiment, the cells are hexagonal cavities, whereby the structure forms a honeycomb structure. The hexagonal cell shape has the best ratio of wall material to cell volume and is an optimal shape in this regard.

It proves advantageous if the cells are round cavities, in particular circular cavities. This cell shape has a ratio of wall material to cell volume which is optimal similarly to the honeycomb structure, and this cell shape can be easily removed from the injection mold.

In another embodiment, the cells are circular recesses in a top plate which is reinforced in the region of the structure. These circular recesses can also be applied in the form of bores after the injection molding. Thus, the arrangement of the cells is particularly flexible.

It is advantageous if the structure has annular elevations and annular cells enclosed by the annular elevations. The injection molding tool for this embodiment can be produced with relatively little effort and is comparatively cost-effective.

It proves advantageous if the annular elevations and the annular cells are arranged concentrically. This arrangement makes it possible for the liquid to adhere to adhere to the inner side of the top plate or to the structure such that the liquid is uniformly distributed thereover.

The invention also provides that the structure is enclosed by a circular groove. In the groove, liquid material is additionally collected and retained, so that the total volume of retained liquid is increased. It is also conceivable for the groove to form the adhesion surface alone, without a structure being present on the inner side of the top plate.

The groove is expediently recessed into the top plate, as a result of which the groove can be produced with little effort during or after the injection molding.

A bead is advantageously formed above the groove on the outer side of the top plate. The bead compensates for the weakening at the top plate that the groove inevitably produces. The bead additionally causes stiffening of the top plate. This has the advantage that the top plate deforms less (i.e., decreased doming) when the bottle has an internal pressure. It is also conceivable to provide the groove without an overlying bead when the top plate is sufficiently thick and therefore no additional stiffening is required. The bead can be immediately recognized on the outer side and can therefore also indicate that the closure cap is advantageously equipped with an adhesion surface.

Since the elevations advantageously have a height between 0.5 and 1.5 mm and advantageously between 0.7 and 1 mm, the cells are sufficiently deep for the capillary action described above to develop.

Since the cells advantageously have a clear width between 3 and 5 mm and more advantageously between 2 and 4 mm, the cells have a sufficiently large filling opening so that liquid is adequately received in the cells. Within the scope of this application, the clear width is to be understood as the greatest possible distance between the elevations bordering a cell.

In an advantageous embodiment of the invention, the closure cap has a cylindrical shell with an internal thread formed on the inner side of the shell, which internal thread can interact with an external thread of the container neck. The interacting threads enable the closure cap to be screwed onto the container neck and unscrewed therefrom again and again. After each opening of the closure cap and shaking of the bottle, liquid adheres to the adhesion surface and, because of the capillary action, does not drip off.

The retaining element can advantageously be realized by at least one retraining strap which undetachably connects the closure cap to the tamper-evident ring. This solution is particularly suitable for screw closures.

The retaining element can also be a hinge which connects the closure cap to the tamper-evident ring in an articulated manner. This solution is particularly suitable for folding or flip-top closures.

A plurality of break-off webs is expediently formed between the tamper-evident ring and the free edge, said break-off webs detachably connecting the tamper-evident ring to the free edge. If the break-off webs are broken, it is clearly indicated to the end user that the container closure has already been opened and is no longer originally sealed.

In another embodiment, the closure cap, the tamper-evident ring, the retaining element and the adhesion surface are produced as a single piece. As a result, no additional processing step is required in order to add an additional part to the container closure.

An inwardly projecting inner cone, e.g., in the form of a sealing cylinder or a sealing ring, or a liner is advantageously molded on the top plate and designed to interact in a sealing manner with the inner wall of the container neck in the closure position. As a result, the container is reliably sealed by the container closure in the closure position even when the container is shaken intensively.

The container closure may be injection-molded from a plastic material, such as PP or HDPE. As a result, the container closure can be produced cost-effectively as a mass product.

Another aspect of the invention relates to a container which is closed with a container closure described further above. Thus, any commercially available container on the container neck of which the container closure fits can be equipped with the adhesion surface. An additional benefit in the form of safe use without risk of soiling is therefore given for the end user.

BRIEF DESCRIPTIONS OF THE DRAWINGS

Figure 2:
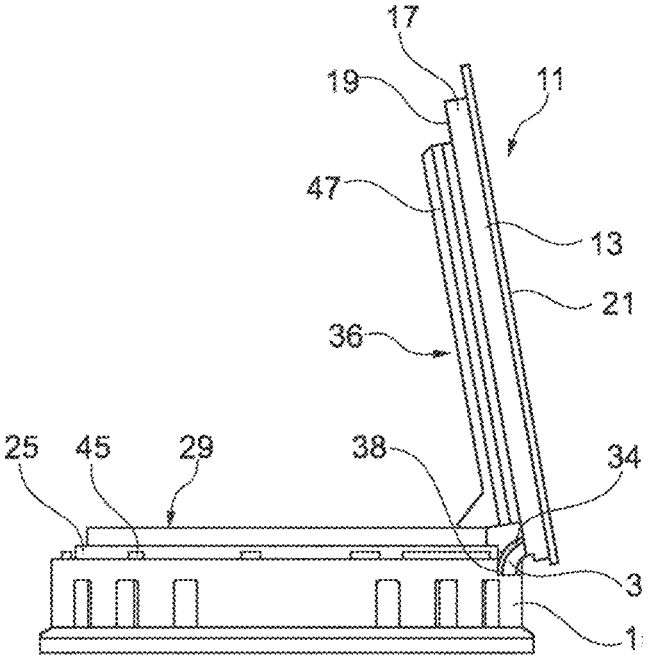
Figure 3:
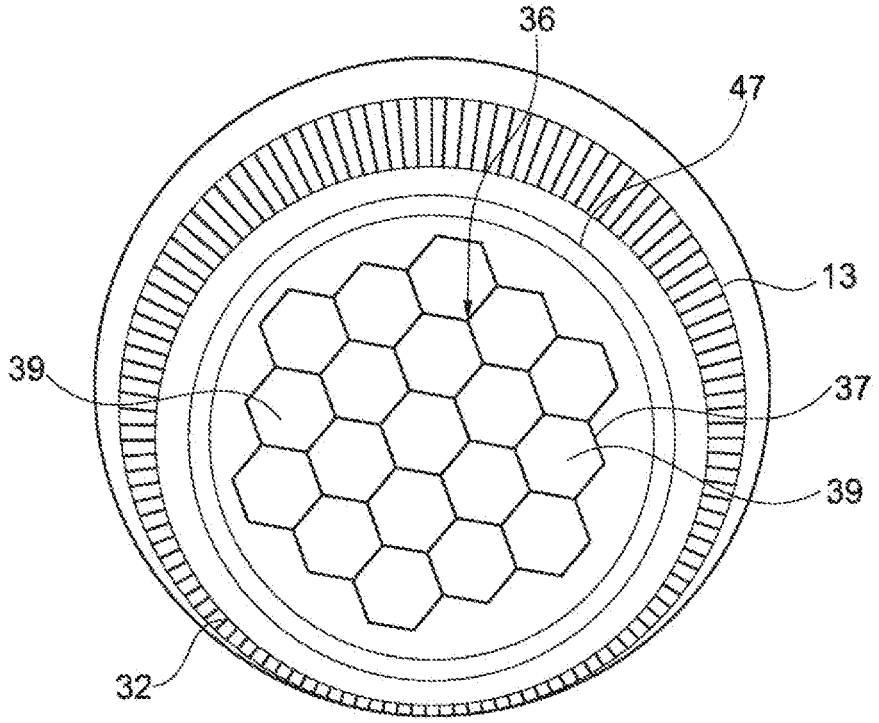
Figure 4:
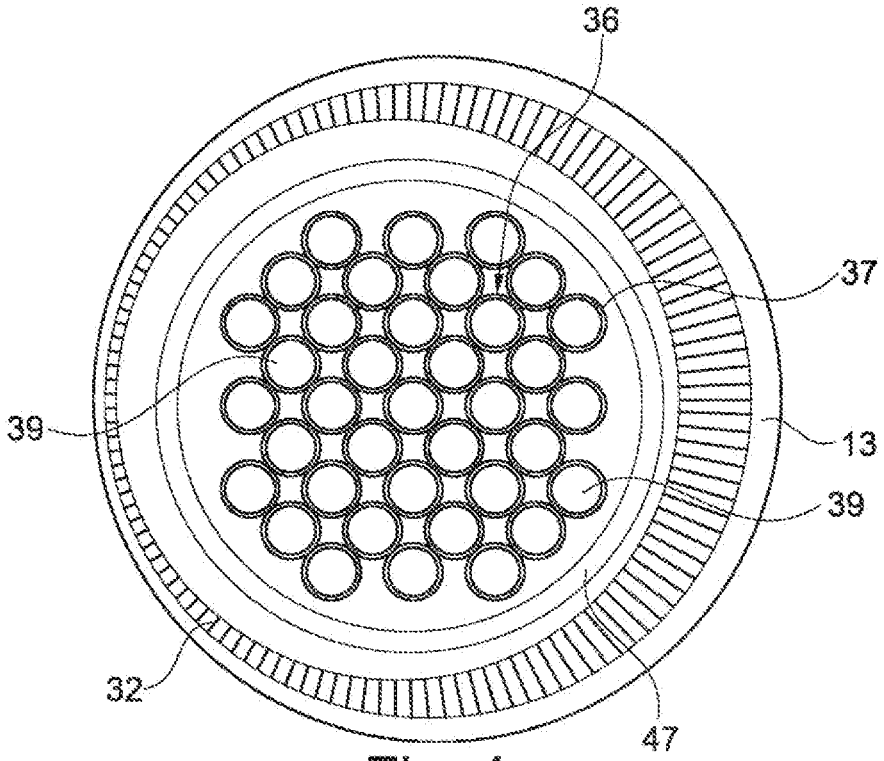
Figure 5:
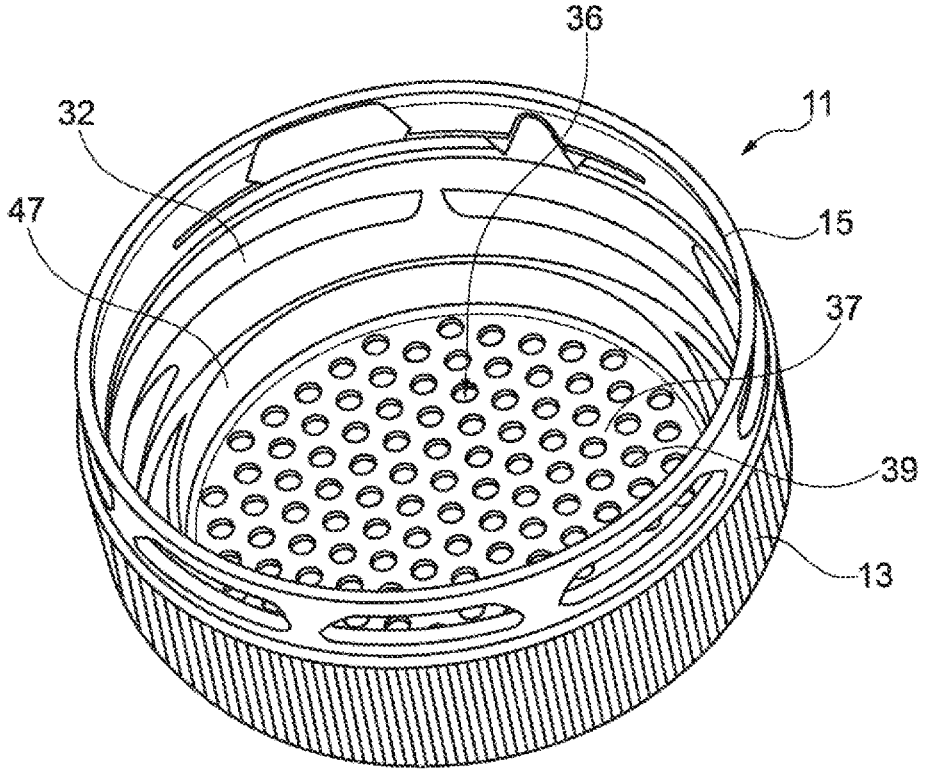
Figure 6:
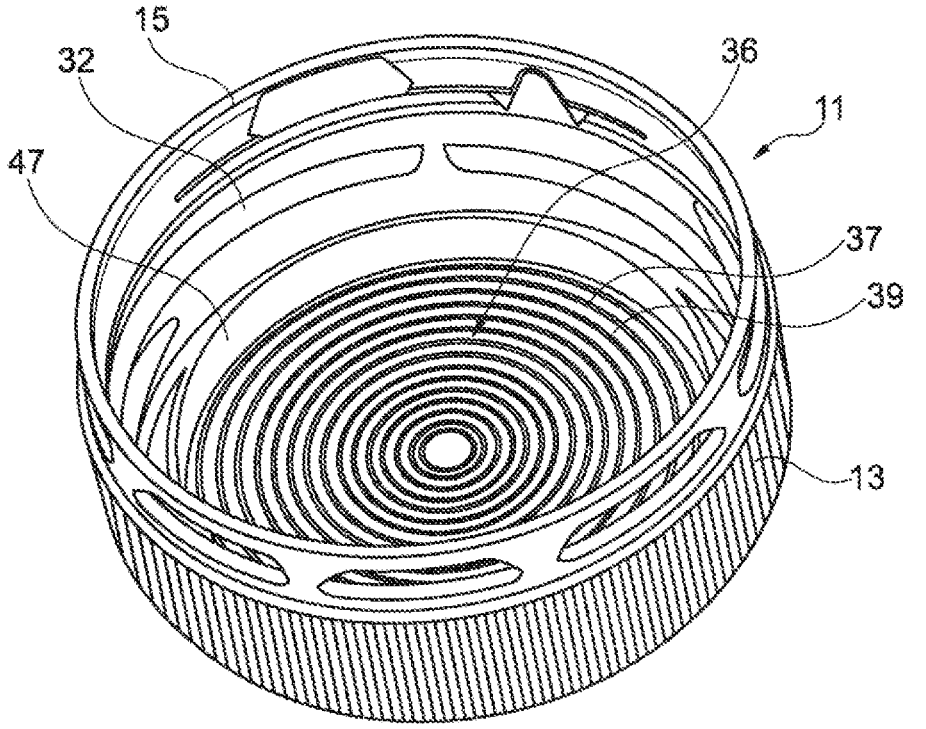
Figure 7:
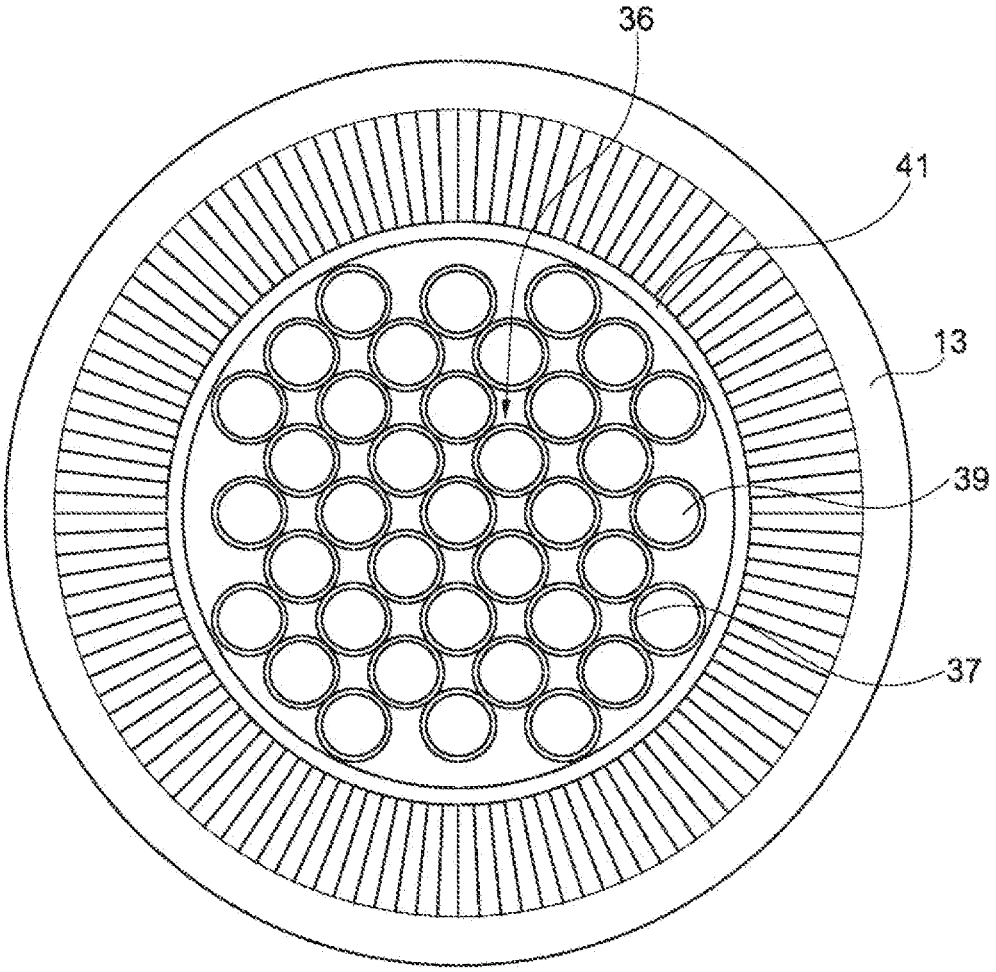
Figure 8:
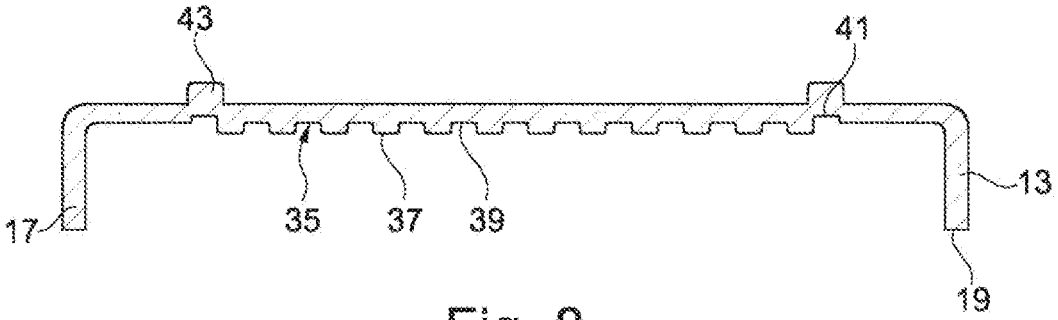

Further advantages and features will become apparent from the following description of an embodiment of the invention with reference to the schematic drawings. In the drawings, which are not true to scale:

FIG. 1: shows a perspective view of a container closure with a tamper-evident ring and two retaining straps, wherein the closure cap is captively retained on the tamper-evident ring by the two retaining straps;

FIG. 2: shows a perspective view of a container closure with a hinge which captively retains the closure cap on the tamper-evident ring;

FIG. 3: shows an interior view of the closure cap with an adhesion surface in a first embodiment;

FIG. 4: shows an interior view of the closure cap with an adhesion surface in a second embodiment;

FIG. 5: shows an interior view of the closure cap with an adhesion surface in a third embodiment;

FIG. 6: shows an interior view of the closure cap with an adhesion surface in a fourth embodiment;

FIG. 7: shows an interior view of the closure cap with an additional groove which surrounds the adhesion surface, and FIG. 8: shows a sectional view of the closure cap of FIG. 7.

DETAILED DESCRIPTION OF THE INVENTION

FIGS. 1 and 2 show container closures of the prior art in a first and second embodiment, which are jointly denoted by the reference numeral 11. The two container closures 11 have in common that they have a closure cap 13 and a tamper-evident ring 15. The closure cap 13 has a shell 17 with a free edge 19. The shell 17 transitions into a top plate 21. With the tamper-evident ring 15, the closure 11 is retained form-fittingly on a container neck 25 of a container 27, in particular a bottle. The container neck 25 transitions into a container body 28.

The closure cap 13 can be transferred between a closed position, in which it closes a pouring opening 29 of the container tightly with respect to the contents, into an open position, in which the pouring opening 29 is opened. The pivoting between the closure position and the open position is made possible by a retaining element. The first end 34 of the retaining element is firmly connected to the free edge 19 and the second end 38 is firmly connected to the tamper-evident ring 15. As a result, the closure cap is captively retained on the tamper-evident ring 15 or on the container 27.

The retaining element can be realized by at least one retaining strap 31. FIG. 1 shows by way of example a first retaining strap 31*a* and a second retaining strap 31*b*. In this embodiment, an internal thread 32 is formed on the inner side of the shell 17, which internal thread can interact with an external thread 33 of the container neck 25. As a result, the closure cap 13 can be screwed onto and unscrewed from the container neck 25.

FIG. 2 shows that the retaining element can also be realized by a hinge 35, in particular a film hinge. By means of the hinge 35, the closure cap 13 can be pivoted away from the pouring opening 29 and can be pivoted toward the pouring opening in order to close it.

In particular when a beverage is shaken in the container 27 or the bottle, the inner side of the top plate 21 comes into intensive contact with the beverage. The liquid adhering to the top plate remains there even after the closure cap 13 has been transferred into the open position. During drinking from the bottle, the liquid adhering to the top plate can drip off and soil the face or the clothing of the end user.

To avoid this, an adhesion surface is provided on the inner side of the top plate 21. This adhesion surface improves the adhesion of the residual amount of liquid to the inner side of the top plate 21. This prevents dripping of the adhering liquid from the top plate 21.

The adhesion surface can be realized by a structure 36. FIGS. 3 to 8 show various embodiments of this adhesion structure 36. The structure 36 has alternating elevations 37 and cells 39. The cells 39 are therefore formed between the elevations. The structure 36 is based on the physical process of capillary action. In a sufficiently narrow cell, water rises, since the capillary force predominates over gravity (capillary rise). Therefore, in the cells 39, an adhesive force is built up between the top disk 21 and the liquid, and this adhesive force keeps the liquid in the cells 39. FIGS. 3, 4 and 6 show that the elevations can be walls 37 which delimit adjacent cells 39. The cells 39 can be polygonal cavities, with hexagonal cavities being advantageous. The resulting honeycomb structure has an optimal ratio of wall material to cell volume.

FIG. 4 shows that the cells 39 can be circular cavities and the elevations can be circular walls 37 which separate adjacent cavities from one another.

FIG. 5 illustrates that the cells 39 are circular recesses. These can be produced by increasing the distances between adjacent recesses in the top plate 21. The elevations 37 are formed between the circular recesses. For example, the top plate 21 can be reinforced in the region of the structure 36 or have an increased thickness into which the recesses are introduced. It is also conceivable for the circular recesses to be drilled into the top plate in this embodiment.

A fourth embodiment is shown in FIG. 6. The elevations 37 can be annular and enclose annular cells 39. These are advantageously arranged concentrically, as a result of which a structure 36 according to the pattern of FIG. 6 is produced.

Each of the structures described above can be enclosed by a circular groove 41, which groove 41 is recessed into the top plate 21. As a result of the provision of the groove 41, a circular bead 43 is formed on the upper side of the top plate 21. Surprisingly, the groove 41 reinforces the capillary action of the structure 36, since liquid is also collected and retained therein. It has been found to be optimal for the capillary action if the elevations 37 have a height between 0.7 and 1.5 mm and the cells 39 have a clear width or an inner diameter between 2 and 4 mm. As a result, in the case of typical beverage bottles and typical beverages (milk-based beverages or fruit juices that have to be shaken) it is possible for the structure 36 to hold up to 2 ml of liquid on the top plate 21.

A plurality of break-off webs 45 is formed between the tamper-evident ring 15 and the free edge 19. The break-off webs 45 detachably connect the tamper-evident ring 15 to the free edge 19. If the webs 45 are broken, this indicates that the closure 11 has already been opened. The closure cap 13, the tamper-evident ring 15, the retaining element 31*a*, 31*b*, 35 and the adhesion surface 36 may advantageously be produced as a single piece. Advantageous materials are PP or HDPE, which are injection-molded to form the container closure.

According to the prior art, the container closure 11 according to FIG. 1 or 2 is equipped with a sealing element 47 so that the closure cap 13 in the closure position seals the pouring opening 29 in a liquid-tight manner.

The invention claimed is:

1. Container closure for closing a pouring opening of a container which is filled with a liquid, comprising:

a closure cap having a free edge, a shell and a top plate, a tamper-evident ring, configured to be retained in a form-fittingly manner on a container neck of the container, a retaining element having a first end and a second end, the first end being firmly connected to the free edge of the closure cap and the second end being firmly connected to the tamper-evident ring, the closure cap being transferable from a closed position, in which it closes the pouring opening, into an open position, in which it fully opens up the pouring opening, and vice versa, and an adhesion surface for improving an adhesion of a liquid on an inner side of the top plate coming into contact with the liquid.

2. Closure according to claim 1, wherein the adhesion surface comprises a structure having alternating elevations and cells, wherein the cells formed between the elevations serve to build up an adhesive force with respect to the liquid.

3. Closure according to claim 2, wherein the elevations are walls enclosing the cells, said walls delimiting adjacent cells.

4. Closure according to claim 2, wherein the cells are polygonal cavities.

5. Closure according to claim 4, wherein the cells are hexagonal cavities, whereby the structure forms a honeycomb structure.

6. Closure according to claim 2, wherein the cells are round cavities.

7. Closure according to claim 2, wherein the cells are circular recesses in the top plate which is reinforced in a region of the structure.

8. Closure according to claim 2, wherein the structure has annular elevations and annular cells enclosed by the annular elevations.

9. Closure according to claim 8, wherein the annular elevations and the annular cells are arranged concentrically.

10. Closure according to claim 2, wherein the structure is enclosed by a circular groove.

11. Closure according to claim 10, wherein the circular groove is recessed into the top plate.

12. Closure according to claim 10, wherein a bead is formed above the circular groove on an outer side of the top plate.

13. Closure according to claim 2, wherein the elevations have a height between 0.5 and 1.5 mm.

14. Closure according to claim 2, wherein the cells have a clear width between 3 and 5 mm.

15. Closure according to claim 1, wherein the closure cap has a cylindrical shell with an internal thread formed on the inner side of the cylindrical shell, which internal thread can interact with an external thread of the container neck.

16. Closure according to claim 15, wherein the retaining element comprises at least one retaining strap which undetachably connects the closure cap to the tamper-evident ring.

17. Closure according to claim 1, wherein the retaining element comprises a hinge which connects the closure cap to the tamper-evident ring in an articulating manner.

18. Closure according to claim 1, further comprising a plurality of break-off webs between the tamper-evident ring and the free edge, said plurality of break-off webs detachably connecting the tamper-evident ring to the free edge.

19. Closure according to claim 1, wherein the closure cap, the tamper-evident ring, the retaining element and the adhesion surface are formed from a single piece.

20. Closure according to claim 1, further comprising an inwardly projecting inner cone, in the form of a sealing cylinder or a sealing ring, or a liner is molded on the top plate and configured to interact in a sealing manner with an inner wall of the container neck in the closed position.

21. Closure according to claim 1, wherein the container closure is injection-molded from a plastic material.

22. Container, comprising:

a container body, a container neck adjoining the container body, and a container closure for closing a pouring opening of the container, comprising:

a closure cap having a free edge, a shell and a top plate, a tamper-evident ring configured to be retained in a form-fitting manner on the container neck of the container, and a retaining element having a first and a second end, the first end firmly connected to the free edge of the closure cap and the second end firmly connected to the tamper-evident ring, and an adhesion surface for improving an adhesion of a liquid on an inner side of the top plate coming into contact with the liquid, whereby the closure cap is transferable from a closed position, in which it closes the pouring opening, into an open position, in which it fully opens up the pouring opening, and vice versa.

* * * * *